US006325701B1

(12) United States Patent
Hoff

(10) Patent No.: US 6,325,701 B1
(45) Date of Patent: Dec. 4, 2001

(54) OSCILLATING ABRASIVE CLEANING MACHINE

(75) Inventor: Thomas M. Hoff, Seminole, OK (US)

(73) Assignee: Georg Fischer Disa Goff, Inc., Seminole, OK (US)

( * ) Notice: Subject to any disclaimer, the term of this patent is extended or adjusted under 35 U.S.C. 154(b) by 0 days.

(21) Appl. No.: 09/557,596

(22) Filed: Apr. 25, 2000

Related U.S. Application Data

(60) Provisional application No. 60/133,851, filed on May 12, 1999.

(51) Int. Cl.[7] ..... B24B 31/06

(52) U.S. Cl. ..... 451/38; 451/38; 451/85; 451/86

(58) Field of Search ..... 451/32, 38, 80, 451/85, 86, 87, 89

(56) References Cited

U.S. PATENT DOCUMENTS

| | | | | |
|---|---|---|---|---|
| 2,108,210 | * | 2/1938 | Rosenberger | 451/85 |
| 2,440,819 | * | 5/1948 | Evans | 451/86 |
| 4,333,276 | * | 6/1982 | Goff | 451/85 |
| 4,368,599 | * | 1/1983 | Hunziker | 451/86 |
| 5,163,253 | * | 11/1992 | Carpenter | 451/86 |
| 5,245,798 | * | 9/1993 | Carpenter | 451/86 |
| 5,405,284 | * | 4/1995 | Brenner et al. | 451/86 |
| 5,676,588 | * | 10/1997 | Frederick et al. | 451/86 |
| 5,782,677 | * | 7/1998 | Kanouse | 451/85 |

* cited by examiner

*Primary Examiner*—George Nguyen
(74) *Attorney, Agent, or Firm*—Finnegan, Henderson, Farabow, Garrett & Dunner, L.L.P.

(57) ABSTRACT

An abrasive cleaning device and method are provided in which a rotating, oscillating drum tumbles articles being cleaned while they are subjected to oscillating blast streams of abrasive particles. Variable closure of alternating portions of an upper opening in the drum through which the blast streams are directed is accomplished by means of a flexible belt that moves in concert with the drum and blast head oscillations.

45 Claims, 7 Drawing Sheets

OSCILLATING ABRASIVE CLEANING MACHINE

This application claims the benefit under 35 U.S.C. §119(e) of U.S. Provisional Application No. 60/133,851 filed May 12,1999.

FIELD OF THE INVENTION

The present invention is directed to an abrasive cleaning device, and, in particular to a cleaning device that has a rotating, oscillating drum for subjecting articles to abrasive blast cleaning.

BACKGROUND OF THE INVENTION

Articles such as automotive parts or castings are sometimes cleaned by a stream of abrasive particles such as shot directed against the articles as they are advanced through a cleaning zone. In order to ensure complete and effective contact of the abrasive stream against all portions of each article as it passes through the zone, the blast heads supplying the abrasive stream may be oscillated transverse to the direction of flow of the articles, and the articles themselves may be tumbled, for example by rotating the drum about its longitudinal axis. Preferably, to ensure complete abrasive contact and cleaning, both tumbling of the articles and oscillating of the abrasive blast heads can be employed together.

Unfortunately, the use of both of these expedients at the same time has diminished their individual effectiveness. As the drum through which the articles pass during cleaning is rotated about its longitudinal axis to tumble the articles, the sides of the drum can interfere with the stream of abrasive from the blast heads, particularly when the blast heads are oscillated to their extreme lateral position. Removal of portions of the sides of the treatment drum to accommodate the full stream of abrasive exposes a greater portion of the interior of the drum to the abrasive stream, but permits a portion of the articles being cleaned and the abrasive to spill out of the drum as it and the blast heads rotate.

One solution has been to provide jointed or hinged rigid side members for the drum which travel along guide members to provide a variable opening into the drum to accommodate the abrasive stream from the oscillating blast heads. Such systems, however, involve complexity and extensive frictional contact, resulting in wear and requiring frequent replacement and added expense.

There is, therefore, a need for an improved oscillating abrasive blast device which achieves the benefits of optimal oscillation of the drum and abrasive blast head while avoiding excess friction and wear and while maintaining the integrity of the drum and enhanced contact of the abrasive stream and articles being cleaned.

SUMMARY OF THE INVENTION

A preferred embodiment of the invention, as embodied and broadly described herein, which addresses the aforementioned needs, comprises an abrasive cleaning machine having an oscillating, rotating drum for receiving and holding articles to be cleaned during an abrasive cleaning process in which the drum is disposed along a longitudinal axis for rotational movement in alternating directions about the axis. A flexible belt has sections that extend around a portion of the circumference of the drum and move transverse to the longitudinal axis of the drum in concert with movement of the drum to maintain articles being cleaned and abrasive particles within the drum; and an oscillating cleaning head, including at least one jet unit, directs streams of abrasive particles through an upper opening in the drum against the articles. The cleaning head is disposed along the upper drum opening in communication with the drum interior, for oscillating movement transverse to the longitudinal axis of the drum in synchronization with oscillating, rotational movement of the drum to thereby direct streams of abrasive particles to specific areas of the drum interior during the oscillating movement of the drum.

The belt sections can be connected to form a unitary member with a portion of the belt in contact with or attached to the base of the drum, and each end of the belt attached to a rotatable spool disposed on opposite sides of the drum for synchronized alternating clockwise and counter-clockwise rotation in response to rotational movement of the drum.

Another preferred embodiment of the invention comprises a method for abrasively treating articles that includes passing the articles into one end of a drum defining a chamber and having an upper opening communicating with the chamber. One or more blast streams of abrasive particles from an abrasive cleaning head are directed through the upper opening against the articles while advancing the articles through the chamber and oscillating the drum rotationally about its longitudinal axis in synchronization with oscillating movement of the cleaning head transverse to the longitudinal axis of the drum to maintain directed communication of the blast streams with specific areas of the chamber and articles within it during the oscillating movement of the drum. Closure to at least a portion of the drum opening opposing the blast streams is provided by means of a flexible belt extending circumferentially around a portion of the drum and moving transverse to the longitudinal axis of the drum in synchronization with rotational oscillation of the drum, to maintain a portion of the belt in contact with a portion of the drum opening.

It is to be understood that both the foregoing general description and the following detailed description are exemplary and explanatory only and are not restrictive of the invention, as claimed.

The accompanying drawings, which are incorporated in and constitute a part of this specification, illustrate an embodiment of the invention and together with the description, serve to explain the principles of the invention.

DESCRIPTION OF THE PREFERRED EMBODIMENT

Reference will now be made in detail to a present preferred embodiment of the invention, an example of which is illustrated in the accompanying drawings. Wherever possible, the same reference numbers will be used throughout the drawings to refer to the same or like parts.

Figure 1:
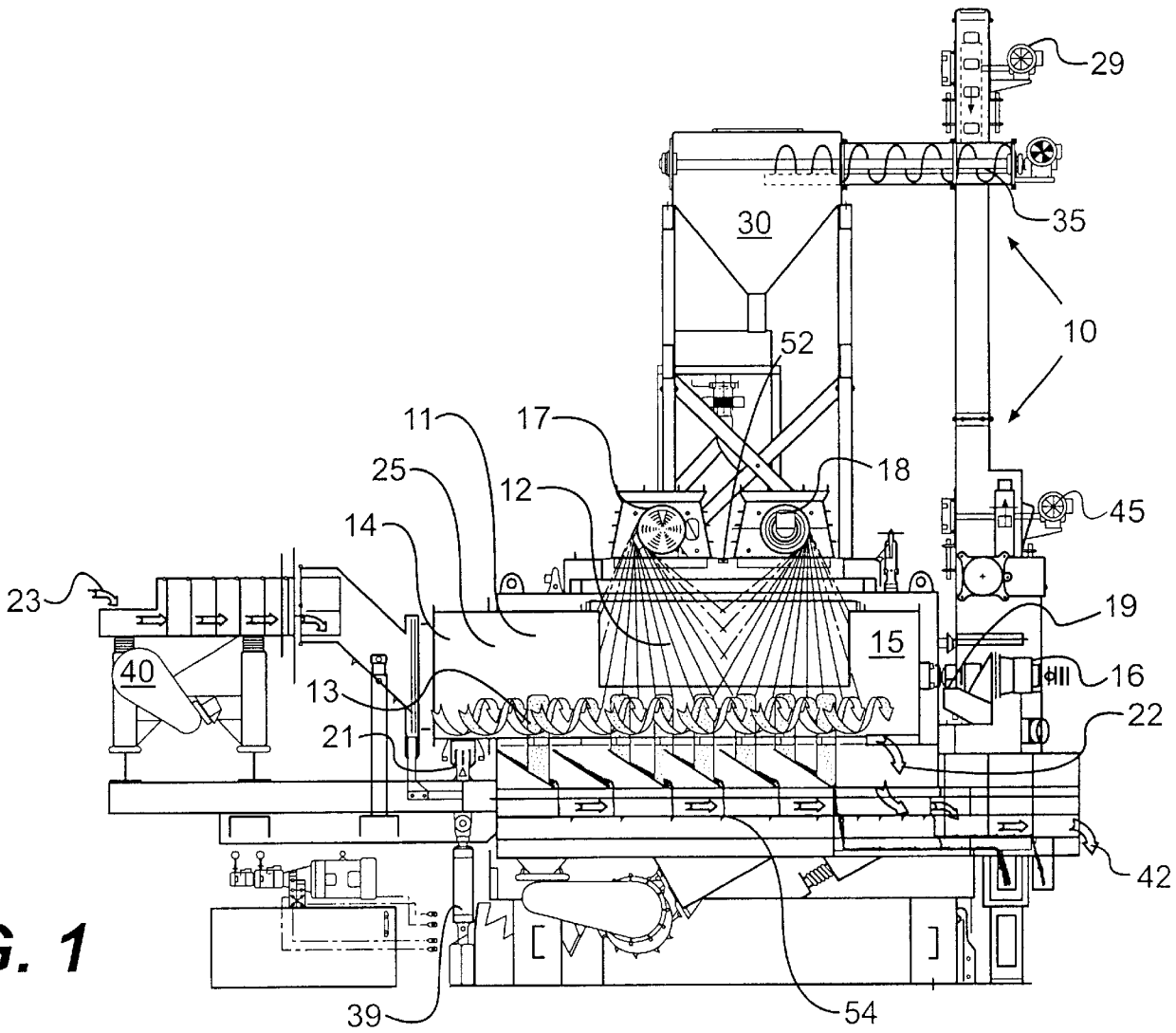
FIG. 1 is a side elevational view of the abrasive cleaning device of the invention.
Figure 2:
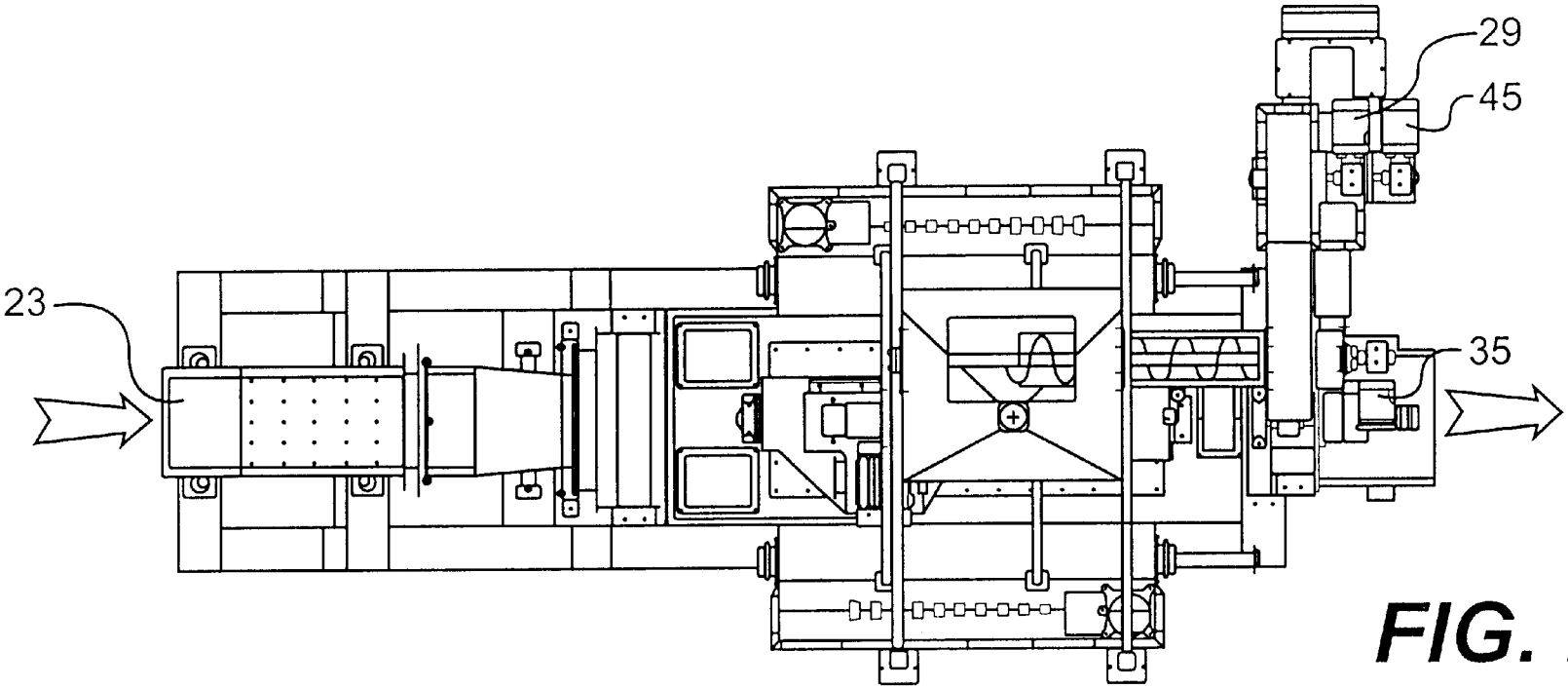
FIG. 2 is a plan view of the abrasive cleaning device of FIG. 1.
Figure 5:
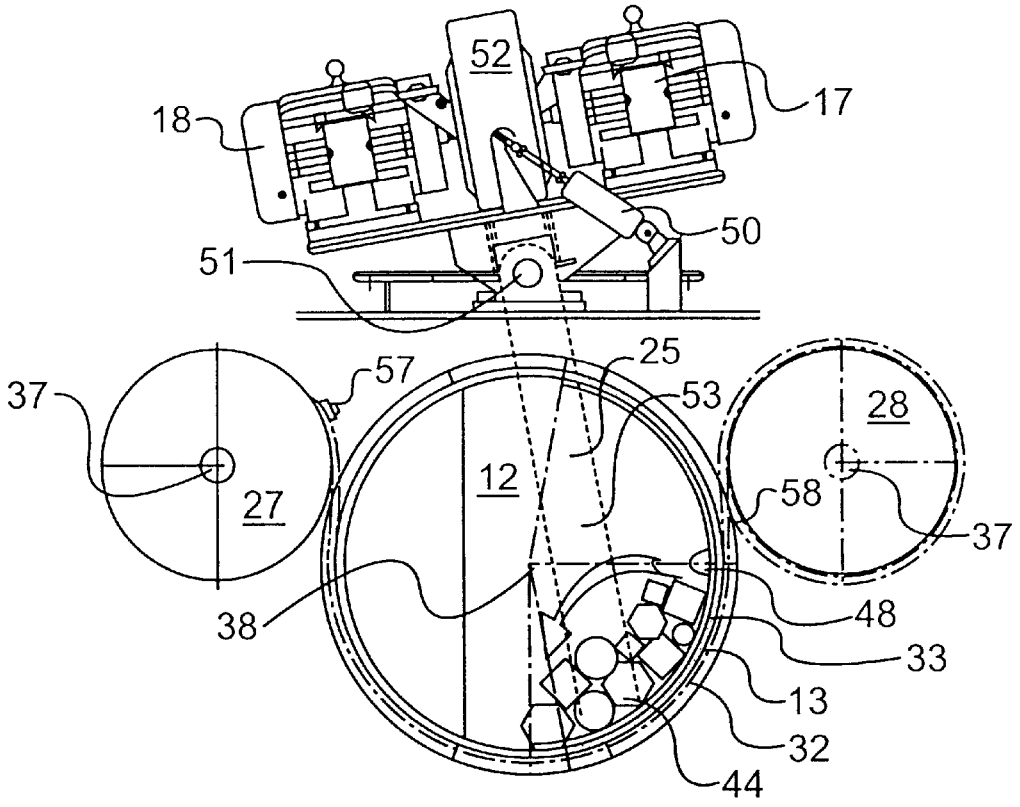
FIG. 5 is a front end view of the abrasive cleaning head used in the device of FIG. 1.

As illustrated in the drawings, and, in particular, FIGS. 1 and 5, an abrasive cleaning machine 10 comprises an oscillating drum 11 for receiving and holding articles to be cleaned such as, for example, automotive brake shoes or other items. The drum 11 defines a chamber 25 disposed along longitudinal axis 38, as shown in FIG. 5, for oscillating, rotational movement in alternating directions about the axis by a drum drive 16 mounted on bearings 14 at the rear 15 of chamber 25.

Figure 4:
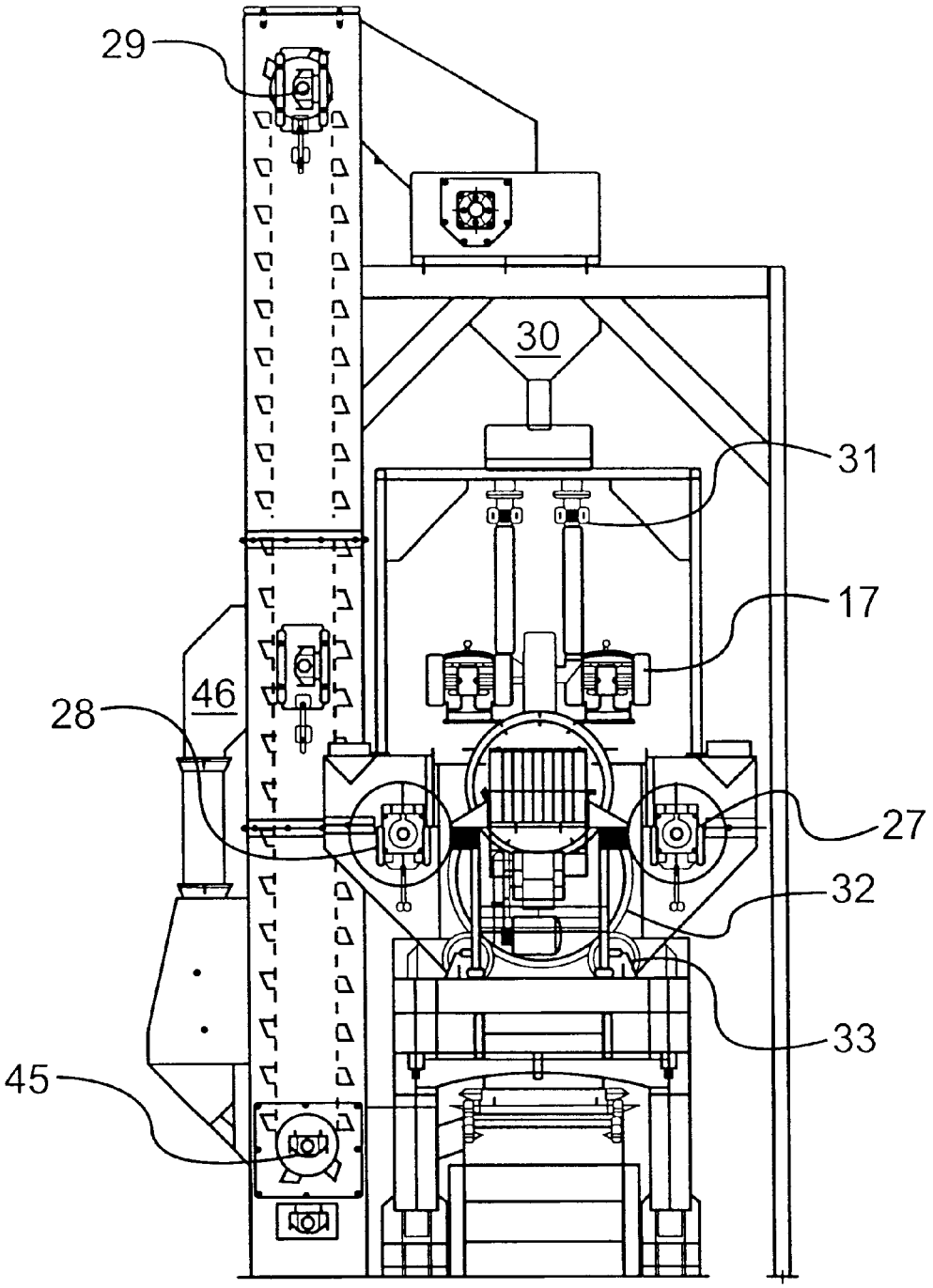
FIG. 4 is a front end view of the abrasive cleaning device of claim 1.

As shown in FIGS. 4 and 5 of the drawings, a flexible belt 32 has sections that extend around a portion of the circumference of the drum 11, contacting the drum so as to move transverse to the longitudinal axis 38 of the drum in concert with movement of the drum. By "transverse" it is meant that movement of the belt is across the longitudinal axis of the drum, either at right or oblique angles.

In the preferred embodiment of the invention illustrated in the drawings, each end of the belt 32 is attached at 57, 58 to one of two spools 27 and 28 disposed on opposite sides of the drum with their respective axis of rotation 37 parallel to the longitudinal axis 38 of the drum. Thus, as the drum is rotated in alternating clockwise and counter-clockwise directions by the drum drive 16, the spools 27 and 28 similarly rotate in synchronization with one another to take up one end of the belt 32 on one spool while the other end of the belt is displaced from the other spool. In this manner, as particularly illustrated in FIG. 5, a full 90° rotation of the drum in each direction can be carried out such that the curved base 13 is rotated to essentially a vertical position while the opposing open side of the drum 11 is covered by the belt 32 to prevent the articles being cleaned 44 and spent abrasive from falling out of the opening in the drum 12. At the same time, the stream of abrasive particles 53 from abrasive cleaning head 52 is maintained and directed through the opening 12 into the drum chamber 25 against the articles 44.

Figure 3:
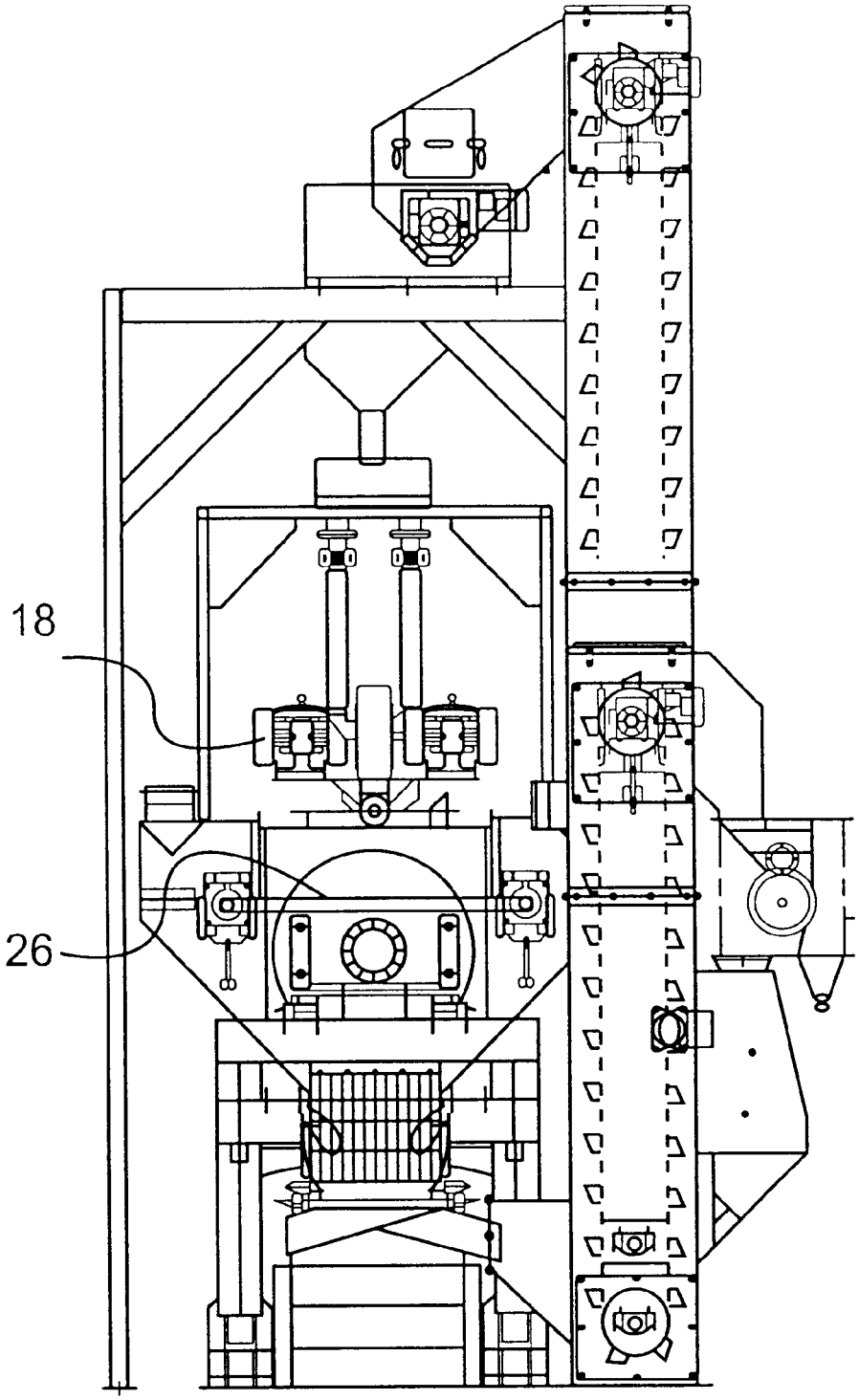
FIG. 3 is a rear end view of the abrasive cleaning device of claim 1.

As heretofore discussed, the two rotating spools 27 and 28 to which the respective ends of the belt 57 and 58 are attached revolve to play out and pick up the respective ends of the belt as it is laterally displaced by rotationally movement of the drum 11. Since the belt is flexible, it is important that rotation of the spools be synchronized in order to maintain proper tension on the belt and prevent it from buckling. Synchronization is accomplished conveniently by means of a sprocket and chain mechanism illustrated in FIG. 3 of the drawings. As shown, each spool 27, 28 is provided with a sprocket that is centrally disposed to turn with the respective spool and the two sprockets are connected by a continuous chain loop 26 so that the two spools turn together. It will be appreciated, that other mechanisms could as well be employed to synchronize the rotation of the two spools.

The oscillating cleaning head 52 is shown in the illustrated embodiment including two jet units 17 and 18 for directing streams of abrasive particles, such as shot, against the articles 44 in the drum 11. The cleaning head 52 is disposed along the upper drum opening 12 with the jet units 17 and 18 in position to direct a stream of abrasive particles 53 into the drum chamber 25. The jet units can be any device for propelling abrasive into the drum including blast wheels or nozzles. Typically, the jet units for directing streams of abrasive particles can be rotary shot wheels, of otherwise conventional design, that fling the particles into the drum chamber by centrifugal force. The oscillating cleaning head 52 is shown disposed for movement transverse to the longitudinal axis 38 of the drum in synchronization with the oscillating rotational movement of the drum to thereby direct communication of the streams of abrasive particles 53 into the interior area of the drum during oscillating rotational movement of the drum. Oscillating movement of the cleaning head assembly 52, which is pivotally mounted at 51, is conveniently accomplished as shown in FIG. 5 by a pneumatic or hydraulic cylinder and piston 50 whose reciprocation can be timed to coincide with the rotational movement of the drum 11. If the cleaning head assembly is not kept in proper alignment and synchronization with the drum assembly 11 as it oscillates back and forth, excessive wear and damage may occur to the drum and belt. If the oscillation speed of the drum, which can be 10 to 15 seconds per oscillation, is changed, the oscillation speed of the cleaning head assembly 52 must also be adjusted, for example, by changing the flow of air or hydraulic fluid into the cylinder controlling movement of the assembly. During the oscillation cycles both the drum 11 and the assembly 52 preferably reach their horizontal positions at the same time.

Figure 6:
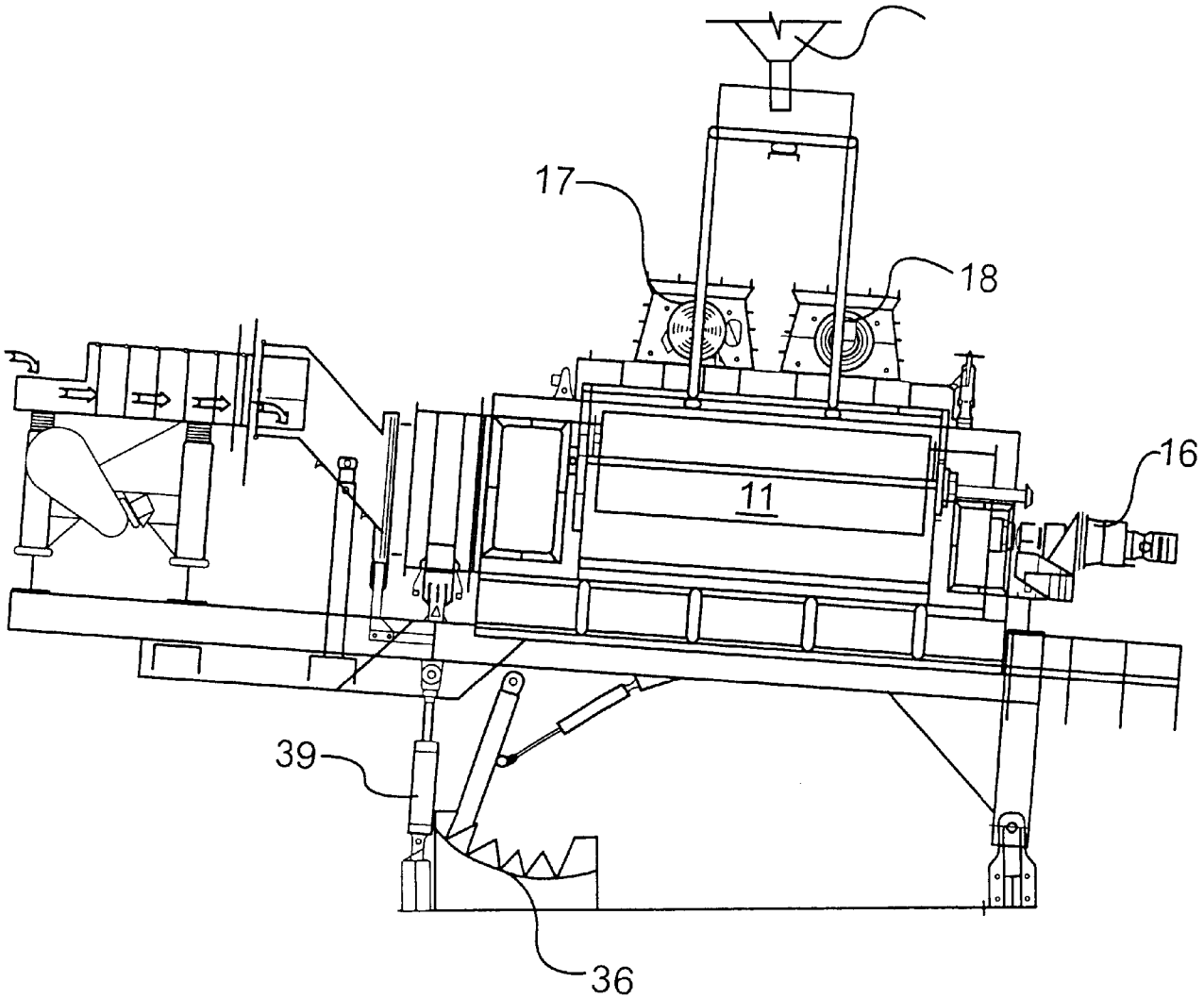
FIG. 6 is a side elevational view illustrating the mechanism for variable inclination of the device of FIG. 1.
Figure 7:
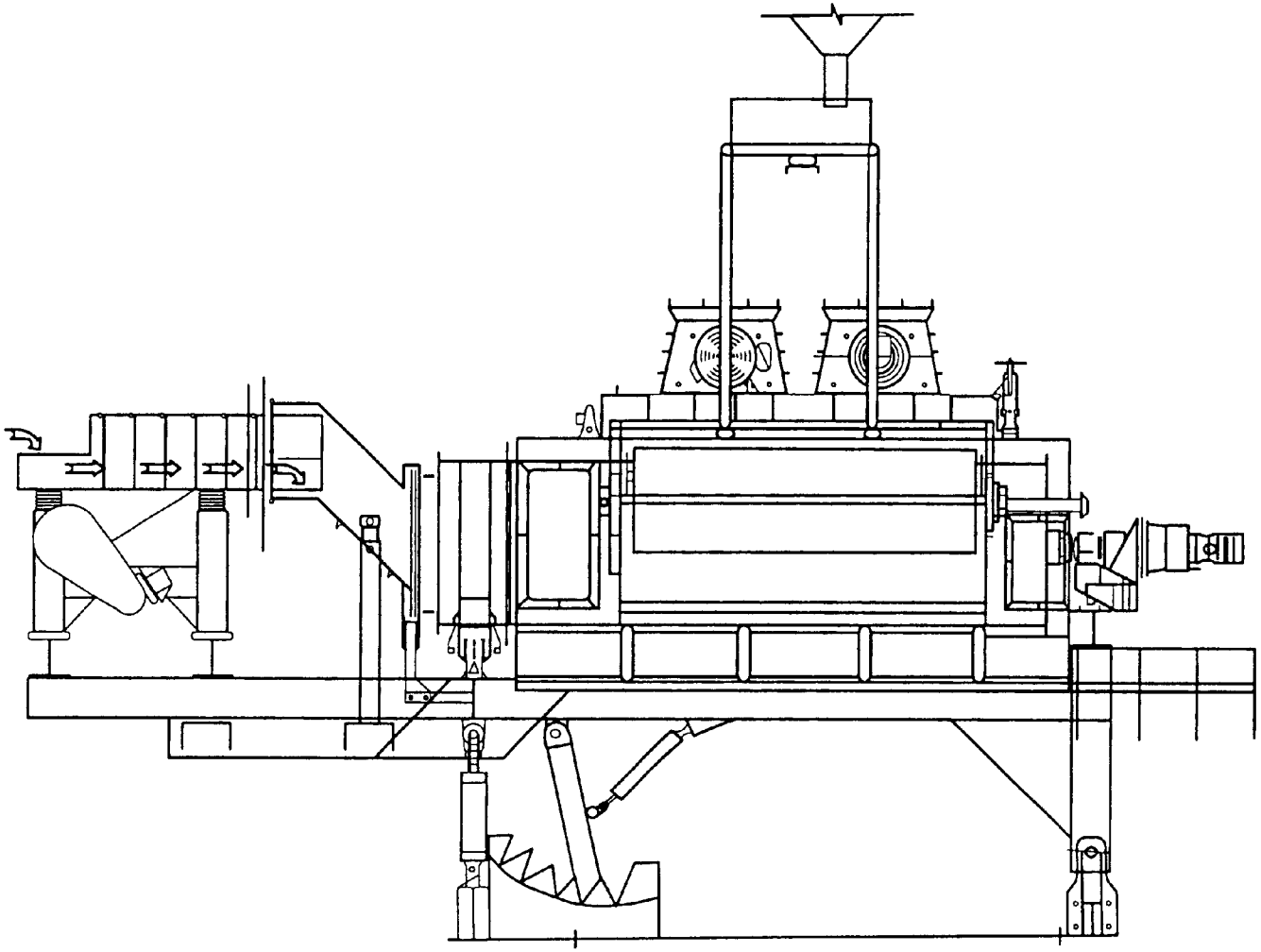
FIG. 7 shows the mechanism of FIG. 6 is lowered configuration.

As further illustrated in the drawings, and in accordance with the illustrated preferred embodiment of the invention, articles to be cleaned enter the cleaning machine at entrance 23 where conveyor mechanism 40 delivers them to the front end 14 of drum 11. As illustrated in FIGS. 6 and 7 of the drawings, the abrasive cleaning machine of the invention is conveniently elevated by about 0 to 4° at the front end 14 by lift 39 such that the drum is held in an inclined downward position by ratchet 36 towards drum discharge opening 22 at the rear end of the device. Hydraulic lift 39, which is controlled by control mechanism 20, allows variable adjustment of the degree of inclination of the device to thereby effect the speed at which articles proceed through the drum. Adjustment of the speed of article travel, amount of abrasive, and drum rotation can be further adjusted by monitoring the weight of articles entering the drum with load sensors 21. As the articles being cleaned move through the oscillating drum chamber 25, they are repeatedly tumbled and continuously exposed to the abrasive jet blast from the abrasive cleaning head 52 and abrasive jet units 17 and 18. As shown in FIG. 5, tumbling of the articles in the drum can be further facilitated by a ridge 48 extending along the base 13 of the drum 11. Spent abrasive material can conveniently be removed continuously from the base 13 of the drum through small apertures 24 onto a conveyor 54 which transfers the spent abrasive to vertical conveyor shown having dual elevator feeds 29 and 45 that transfer the abrasive to an overhead horizontal transfer screw 35 which conveys the abrasive to hopper 30 where it is funneled back into the abrasive cleaning head mechanism 52.

Load cells permits determination of exactly how many pounds of parts are inside the drum. The load cells 21 may generate a 4–20 mA signal that is sent to an analog input card in the programmable logic controller. This weight reading determines how much abrasive should be thrown at the parts. If there is only a small amount of parts inside the drum, only a slight amount of abrasive is thrown. This keeps the wear on the drum at a minimum. When a small volume of parts is in the drum, the inside of the drum is not completely covered. However, when the drum is 30% full (maximum loading for certain designs), the maximum amount of abrasive is thrown.

As illustrated in the drawings, the drum 11 may typically have a cylindrical configuration with a curved base 13. This configuration has the particular advantage of facilitating oscillating rotation of the drum, for example, on trunnion roll supports 33 as illustrated in FIG. 4 of the drawings. Other configurations for the drum can, however, be employed within the scope of the present invention as long as rotation of the drum is not The production flow rate through the machine is controlled by three variables. The first is the rotational speed of the drum. By utilizing a variable volume pump, one can electronically change the rotational speed of the drum. From the horizontal or neutral position, the drum will rotate 90 degrees clockwise and stop. From this position, the drum will rotate 180 degrees, in the opposite direction, until it reaches a stop position. The drum will then reverse and travel 180 degrees until it reaches the original position again. This cycle will continually repeat. By electronically changing the rational speed, you have complete control over the amount of time it takes the drum to move between positions. The shorter this time is, the faster the parts move through the drum. The longer this time induces slower part travel through the drum.

The second variable, which controls the production rate, is the inclination angle of the drum. This is adjustable from 0 to 4 degrees. 0 degrees of inclination will induce no horizontal movement of the parts. This selection is provided only for assembly and installation ease. At 1 degree of incline, the parts will begin flowing through the machine. As the angle increases, the flow rate of the parts will be increased or the retention time of the parts inside the drum will decrease.

The third and final variable, which controls the rate, is the dwell time. When the drum rotates to the first stop position and then changes direction to begin moving to the second stop position, the amount of time the drum will stay stationary before reversing can be controlled. This is called the dwell time. The higher the value for the dwell time, the longer the parts stay inside the drum.

In the preferred embodiment of the invention illustrated in the drawings, a unitary flexible belt whose ends are attached to respective spools is shown. Typically, the belt can be constructed of various elastomeric materials, such as rubber, and can be reinforced by wire, fabric, or other materials for additional strength and durability. It will be apparent, however, that it is not essential that the belt be unitary or that the ends of the belt be connected to revolving spools. Alternatively mechanism can as well be employed for example, to play out and take up the ends of belts sections attached to the sides of the drum as the drum rotates. The essential feature of the invention will be understood to, be providing variable closure for the opening in the side of the drum to thereby prevent the articles being cleaned and spent abrasive from falling out of the revolving drum while at the same time allowing the blast of abrasive material to have continuing egress into the drum chamber and the articles being cleaned as they are tumbled.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An abrasive cleaning machine comprising:

an oscillating drum for receiving and holding articles to be cleaned during an abrasive cleaning process, the drum defining a chamber and being disposed along a longitudinal axis foroscillating rotational movement in alternating directions about said axis by a mechanism; the drum having an upper opening communicating with the chamber, a base, and two spaced apart end sections defining the front and rear of the chamber;

a flexible belt having sections that extend around a portion of the circumference of the drum, the belt sections moving transverse to the longitudinal axis of the drum in concert with movement of the drum to provide variable closure to portions of said opening; and an oscillating cleaning head including at least one jet unit for directing streams of abrasive particles against the articles in the drum, the cleaning head being disposed along the upper drum opening with at least one jet unit in communication with the drum chamber, for oscillating movement transverse to the longitudinal axis of the drum in synchronization with oscillating rotational movement of the drum to thereby direct communication of the streams of abrasive particles with specific areas of the drum chamber during the oscillating rotational movement of the drum.

2. The abrasive cleaning machine of claim 1 wherein oscillating movement of the drum is in alternating rotational directions of up to about 90° each way.

3. The abrasive cleaning machine of claim 1 wherein the front end of the drum is adapted to receive the articles to be cleaned and the base of the drum proximate its rear end is adapted to dispense cleaned articles.

4. The abrasive cleaning machine of claim 3 wherein the drum is inclined downward from the front end to the rear end to facilitate movement of the articles through the drum.

5. The abrasive cleaning machine of claim 4 wherein the inclination of the drum is adjustable.

6. The abrasive cleaning machine of claim 1 wherein said base extends, on either side of the drum to the upper opening.

7. The abrasive cleaning machine of claim 1 wherein said belt extends sufficiently around the circumference of the drum to substantially maintain articles being cleaned and abrasive particles within the chamber of the drum during oscillating rotational movement thereof.

8. The abrasive cleaning machine of claim 7 wherein one of the sections of the belt engages a portion of the upper opening during a portion of the oscillating rotational movement of the drum.

9. The abrasive cleaning machine of claim 1 wherein the belt has two end sections, each of which is attached to one of two rotatable spools disposed on opposite sides of the drum.

10. The abrasive cleaning machine of claim 1 wherein the sections of the belt are joined to form a unitary member.

11. The abrasive cleaning machine of claim 1 wherein the sections of the belt are unconnected with one another.

12. The abrasive cleaning head of claim 1 wherein the cleaning head is pivotally disposed along the upper drum opening.

13. The abrasive cleaning machine of claim 1 wherein at least one abrasive jet unit is a shot wheel.

14. The abrasive cleaning machine of claim 12 wherein the abrasive cleaning head is attached to a pneumatic piston for controllably causing oscillating movement of the cleaning head.

15. The abrasive cleaning machine of claim 1 which includes a provision for collecting spent abrasive particles from the drum and returning them to at least one abrasive jet unit.

16. The abrasive cleaning machine of claim 15 wherein said provision includes a conveyor system for transferring said particles from the drum to the abrasive jet unit.

17. The abrasive cleaning machine of claim 1 which includes a load sensor for determining the weight of the articles being cleaned in the drum.

18. The abrasive cleaning machine of claim 1 wherein a portion of the belt is attached to the base of the drum.

19. The abrasive cleaning machine of claim 1 wherein the base of the drum is curved.

20. The abrasive cleaning machine of claim 1 wherein the drum defines an elongated chamber.

21. The abrasive cleaning machine of claim 1 wherein the cleaning head is attached to a hydraulic piston for controllably causing oscillating movement of the cleaning head.

22. An abrasive cleaning machine comprising:

a drum for receiving and holding articles to be cleaned during an abrasive cleaning process, the drum defining a chamber disposed along a longitudinal axis for oscillating rotational movement along said axis, the drum having an upper opening communicating with said chamber, a base, and two spaced apart end sections defining the front and rear of the chamber;

means for effecting said oscillating rotational movement of the drum in alternating directions about said axis;

a flexible belt having two end portions and a middle portion, each end portion of the belt being attached to one of two opposing rotatable spools disposed on opposite sides of the drum with their respective axis of rotation parallel to the longitudinal axis of the drum, a portion of the belt being attached to the base of the drum and extending around a portion of the circumference thereof such that the belt moves transverse to said longitudinal axis in response to movement of the drum;

means connected to said spools for synchronizing alternating clockwise and counter clockwise rotation together of the spools in response to said movement of the belt; and an abrasive cleaning head including at least one abrasive jet unit for directing streams of abrasive particles against the articles in the drum, the cleaning head being pivotally disposed along the upper drum opening with at least one jet unit in communication with the drum chamber, and means for causing oscillating movement of the cleaning head transverse to said longitudinal axis in synchronization with oscillating rotational movement of the drum to maintain directed communication of the streams of abrasive particles with specific areas of the drum chamber during the oscillating movement of the drum.

23. The abrasive cleaning machine of claim 22 wherein the oscillating rotational movement of the drum is in alternating directions of up to about 90° each way.

24. The abrasive cleaning machine of claim 22 wherein the front end of the drum is adapted to receive the articles to be cleaned and the base of the drum proximate its rear end is adapted to dispense the cleaned articles.

25. The abrasive cleaning machine of claim 24 wherein the drum is inclined downward from the front end to the rear end to facilitate movement of the articles through the drum.

26. The abrasive cleaning machine of claim 22 wherein the base extends on either side of the drum to about the upper opening.

27. The abrasive cleaning machine of claim 22 wherein the belt extends sufficiently around the circumference of the drum to substantially maintain articles being cleaned within the chamber of the drum during oscillating rotational movement thereof.

28. The abrasive cleaning machine of claim 24 wherein the belt engages portions of the upper opening during a portion of the oscillating rotational movement of the drum.

29. The abrasive cleaning machine of claim 25 wherein the inclination of the drum is adjustable.

30. The abrasive cleaning machine of claim 22 wherein the abrasive jet units are two shot wheels.

31. The abrasive cleaning machine of claim 22 wherein the means for controllably causing oscillating movement of the cleaning head is a pneumatic piston.

32. The abrasive cleaning machine of claim 22 which includes means, for collecting spent abrasive particles from the drum and returning them to the plurality of abrasive jet units.

33. The abrasive cleaning machine of claim 22 which includes a load sensor for determining the weight of the articles being cleaned in the drum.

34. The abrasive cleaning machine of claim 22 wherein the base of the drum is curved.

35. The abrasive cleaning machine of claim 22 wherein the means for controllably causing oscillating movement of the cleaning head is a hydraulic piston.

36. The abrasive cleaning machine of claim 22 wherein the means for effecting oscillating rotational movement of the drum is a bi-directional rotary power source.

37. The abrasive cleaning machine of claim 22 wherein the means for synchronizing alternating clockwise and counterclockwise rotation of the spools is a sprocket and chain assembly connecting said spools.

38. The abrasive cleaning machine of claim 36 wherein said power source is a hydraulic motor.

39. A method for abrasively treating articles comprising:

passing said articles into one end of a drum defining a chamber and having an upper opening communicating with the chamber;

directing one or more blast streams of abrasive particles from an oscillating abrasive cleaning head through said opening against the articles while advancing the articles through the chamber;

oscillating the drum rotationally about its longitudinal axis in synchronization with oscillating movement of the cleaning head transverse to the longitudinal axis of the drum to maintain directed communication of the blast streams with specific areas of the chamber and articles during oscillating movement of the drum;

providing closure to at least a portion of the drum opening opposing the blast streams by means of a belt extending circumferentially around a portion of the drum and moving transverse to the longitudinal axis of the drum in synchronization with rotational oscillation of the drum, to maintain a portion of the belt in contact with the drum; and advancing said articles passed said blast streams and removing them from said drum at a point downstream thereof.

40. The method of claim 39 wherein said treatment is cleaning.

41. The method of claim 39 wherein said drum is rotated about 90° in both directions.

42. The method of claim 39 wherein each end of the belt is attached to one of two spools, each disposed respectively on opposite sides of the drum for rotation in synchronization with one another in response to oscillating rotation of the drum.

43. The method of claim 39 wherein spent abrasive cleaning particles are collected from the drum and recycled to the cleaning head.

44. The method of claim 39 wherein the articles passing through the chamber are tumbled by the oscillating rotation of the drum.

45. The method of claim 44 wherein the articles are maintained substantially in contact with the blast streams during advancement through the chamber.

* * * * *

UNITED STATES PATENT AND TRADEMARK OFFICE

CERTIFICATE OF CORRECTION

PATENT NO. : 6,325,701 B1
DATED : December 4, 2001
INVENTOR(S) : Thomas M. Hoff

It is certified that error appears in the above-identified patent and that said Letters Patent is hereby corrected as shown below:

Column 5,
Line 63, "foroscillating" should read -- for oscillating --.

Column 6,
Line 28, "extends, on" should read -- extends on --.

Column 8,
Line 2, "means, for" should read -- means for --.

Signed and Sealed this

Thirtieth Day of April, 2002

*Attest:*

*Attesting Officer*

JAMES E. ROGAN
*Director of the United States Patent and Trademark Office*